US007766683B2

(12) United States Patent
Nagano et al.

(10) Patent No.: US 7,766,683 B2
(45) Date of Patent: Aug. 3, 2010

(54) COVER ATTACHING STRUCTURE, HOUSING AND COVER

(75) Inventors: Toru Nagano, Makinohara (JP); Hideki Honma, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/204,652

(22) Filed: Sep. 4, 2008

(65) Prior Publication Data

US 2009/0061672 A1 Mar. 5, 2009

(30) Foreign Application Priority Data

Sep. 4, 2007 (JP) ..... 2007-228834

(51) Int. Cl.
*H01R 13/62* (2006.01)

(52) U.S. Cl. ..... 439/296

(58) Field of Classification Search ..... 439/296, 439/76.1, 607.22, 946, 95, 330, 468; 361/737
See application file for complete search history.

(56) References Cited

U.S. PATENT DOCUMENTS 4,749,369 A * 6/1988 Wang ..... 439/459
4,954,088 A * 9/1990 Fujizaki et al. ..... 439/73
6,174,193 B1 * 1/2001 Nagano ..... 439/468
6,191,950 B1 * 2/2001 Cox et al. ..... 361/737
6,632,097 B2 * 10/2003 Chang ..... 439/76.1

FOREIGN PATENT DOCUMENTS

JP 09-306583 A 11/1997

* cited by examiner

*Primary Examiner*—Edwin A. Leon
(74) *Attorney, Agent, or Firm*—Sughrue Mion, PLLC

(57) ABSTRACT

A cover attaching structure in a connector includes: first and second locking portions provided on a first attaching member; and third and fourth locking portions provided on a second attaching member which is attached to the first attaching member. The first locking portion is locked on the third locking portion from an outer surface side of the connector. The second locking portion is locked on the fourth locking portion from an inner surface side of the connector.

9 Claims, 8 Drawing Sheets

COVER ATTACHING STRUCTURE, HOUSING AND COVER

BACKGROUND OF THE INVENTION

1. Technical Field

The present invention relates to a cover attaching structure for attaching a cover to a housing provided on a connector, and a housing and a cover which constitute the cover attaching structure.

2. Background Art

Conventionally, a connector with an electric wire cover is disclosed in JP-A-9-306583 as a connector which includes a cover that is attached to a housing. A box-shaped cover is fitted on the housing on a side thereof where an electric wire outlet port is made to open so as to be fixed thereto. An electric wire drawn out from the electric wire outlet port passes through an opening provided in a side wall of the cover and is then drawn out to the outside.

Rod-shaped ribs extend from a pair of edge portions, which face each other, of the electric wire outlet port opening towards a direction in which the cover is attached or detached. A projecting piece is provided on an internal surface of the rib which faces the electric wire outlet port opening in such a manner as to extend in a direction in which the rib extends. Locking projecting portions project outwards from respective side walls which are adjacent to the positions where the ribs extend in such a manner to hold the edge portions of the electric wire outlet port opening.

Groove-shaped depressed wall surfaces are provided on a pair of circumferential walls, which face each other, of the cover in such a manner as to extend from an opening edge portion of the cover along a direction in which the cover is attached to or detached from the housing. A slit is formed in the depressed wall surface in such a manner as to extend from the opening edge portion of the cover to a central portion thereof in a direction in which the slit extends. A portion above the depressed wall surface which lies at the opening edge portion of the cover is covered by a locking piece. The locking piece is made up of a plate-shaped element which is held by a pair of slits therebetween which lie on both side portions of the depressed wall surface and extend from the opening edge portion of the cover along a direction in which the depressed wall surface extends so as to impart flexibility thereto. A locking hole is formed in a central portion of the locking piece in such a manner as to pierce both main surfaces so that the depressed wall surface is exposed therethrough to the outside.

When attached to the housing, the cover accommodates the ribs of the housing in the depressed wall surfaces, with the projecting pieces of the ribs fitted in the slits of the depressed wall surfaces and the locking hole of the locking piece locked by the locking projecting portion. The dislocation of the ribs from the depressed wall surfaces to an opening end side of the cover is prevented by the locking between the locking piece and the locking projection.

In the conventional connector that has been described above, when a load is exerted on the housing or the cover as a result of the effect of vibration exerted thereon from the outside, the locking between the locking piece and the locking projecting portion is released, whereby the ribs are displaced from the depressed wall surfaces, leading to a fear that the cover falls from the housing. In particular in the event that warpage is generated in the locking piece when the cover is molded, the locking piece is bended, whereby the locking with the locking projecting portion is released, and this causes the cover to fall from the housing easily.

SUMMARY OF THE INVENTION

The present invention has been made in view of these situations and an object thereof is to provide a cover attaching structure, a housing and a cover which can prevent the fall of the cover from the housing.

With a view to attaining the object, according to an aspect of the invention, there is provided a cover attaching structure in a connector, including: first and second locking portions provided on a first attaching member; and third and fourth locking portions provided on a second attaching member which is attached to the first attaching member, wherein the first locking portion is locked on the third locking portion from an outer surface side of the connector; and wherein the second locking portion is locked on the fourth locking portion from an inner surface side of the connector.

In addition, the first and second locking portions are provided on at least one locking wall of the first attaching member, and the third and fourth locking portions are provided on a plurality of locking walls of the second attaching member.

In addition, the locking wall of the first attaching member is disposed between the plurality of the locking walls of the second attaching member in a state where inner and outer surfaces of the locking wall of the first attaching member abut on or are close to the plurality of the locking walls of the second attaching member.

In addition, at least one of the first and third locking portion has a projection, and at least one of the second and third locking portion has a projection.

In addition, the first attaching member is a housing, and the second attaching member is a cover, the housing includes a wire port into which the wire is inserted, the cover includes an inner wall which is fitted to inside of the wire port, and an outer wall which is fitted to outside of the wire port, a peripheral wall of the wire port serves as the first locking wall, and the inner and outer walls of the cover serve as the second locking walls.

According to the aspects of the invention, the fall of the cover from the housing can be prevented.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Hereinafter, a preferred embodiment for carrying out the invention will be described by reference to the drawings.

Figure 1:
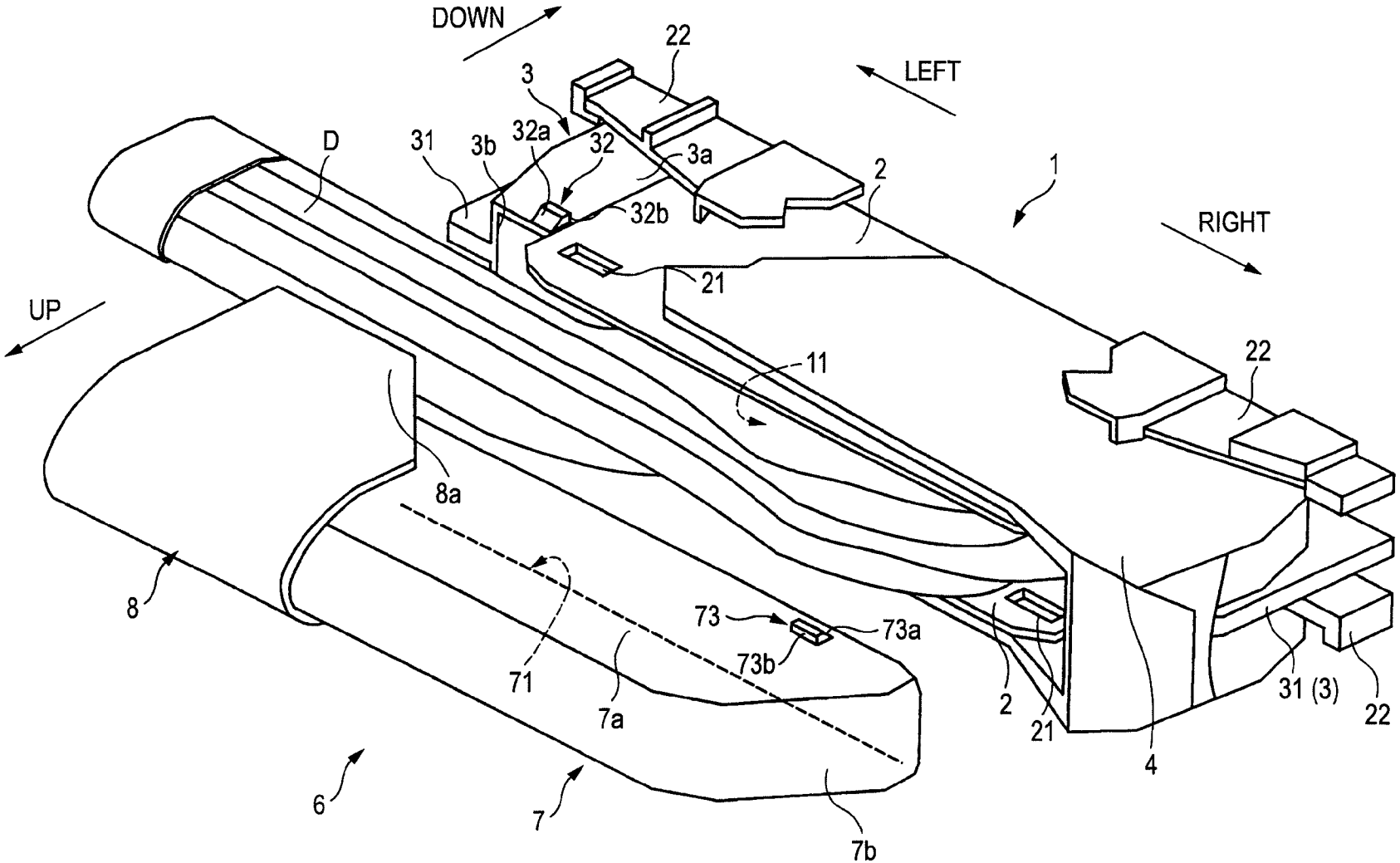
FIG. 1 is a perspective view, as seen from above, showing a state in which an electric wire cover is attached to a housing provided on a connector according to an embodiment of the invention.
Figure 2:
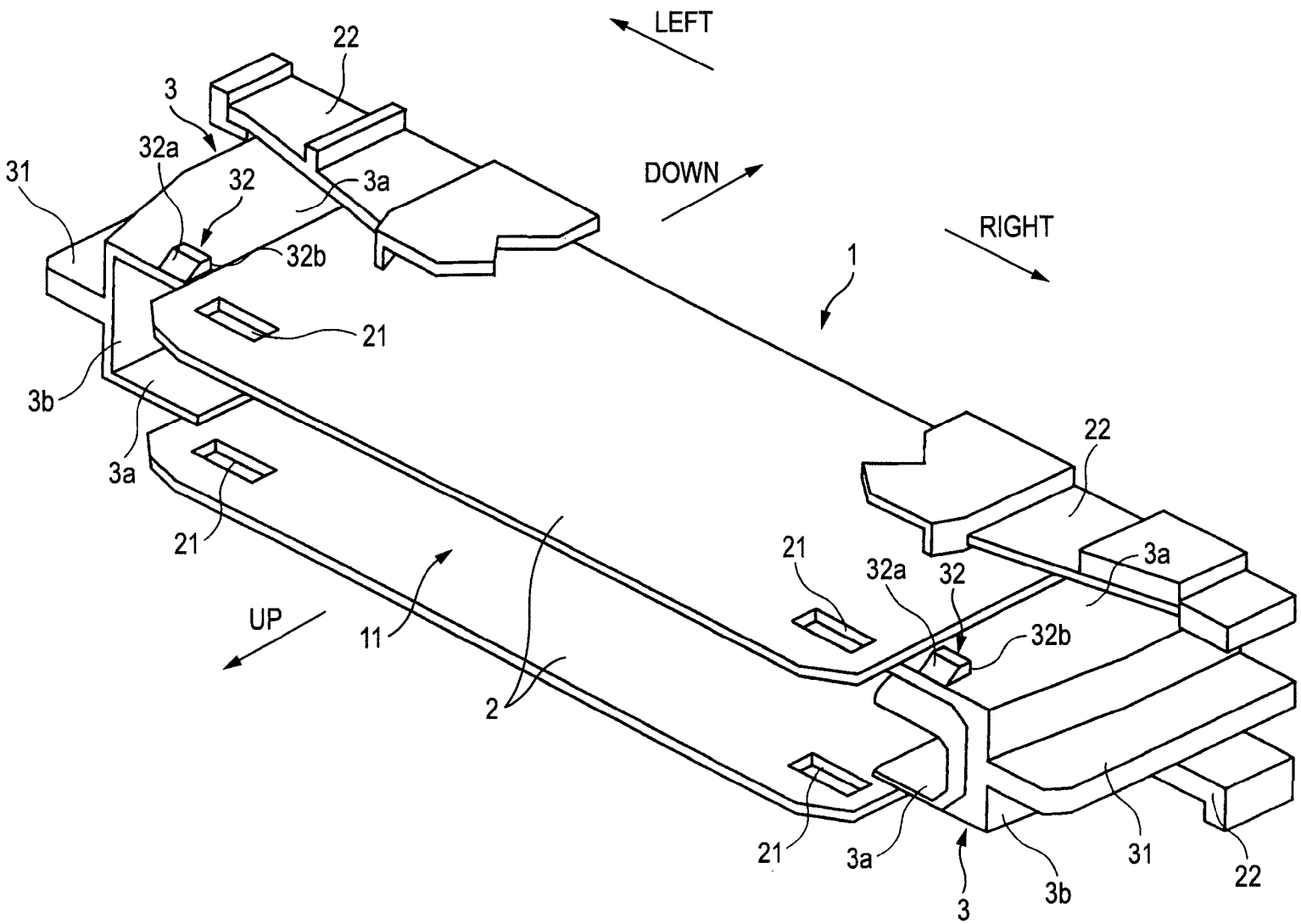
FIG. 2 is a perspective view, as seen from above, showing an external appearance of the housing shown in FIG. 1.

FIG. 1 is a perspective view, as seen from thereabove, which shows a state in which an electric wire cover 6 is being attached to a housing 1 that is provided on a connector of the embodiment. In addition, FIG. 2 is a perspective view, as seen from thereabove, which shows an external appearance of the housing 1. Note that upward, downward, leftward and rightward directions used in the following description are shown in the respective drawings. These upward, downward, leftward and rightward directions so described are given for the purpose of explanation and may, of course, be different from an actual layout.

As is shown in FIG. 1, a connector is configured to include a housing 1 which includes a plurality of terminal cavities in an interior thereof and an electric wire cover 6 for protecting electric wires D drawn out of the housing 1. As is shown in FIG. 2, the housing 1 is configured to include a pair of main circumferential walls 2 which are formed wide and are made to face each other and connecting circumferential walls 3 which are situated on left- and right-hand sides of both the main circumferential walls 2 to connect together these main circumferential walls 2 and has a flat, substantially box-shaped external shape.

The connecting circumferential walls 3 are made integral with the main circumferential walls 2 and each have a height which is slightly lower than the main circumferential wall 2. The connecting circumferential walls 3 each include a pair of main wall portions 3*a* which extend sideways from left- or right-hand side edge portions of the respective main circumferential walls 2 and a side wall portion 3*b* which connects together edge portions of the main wall portions 3*a* which lie in a direction in which both the main wall portions 3*a* extend, and the connecting circumferential wall portion 3*a* exhibits a frame shape having a collapsed U-shaped cross section as viewed from the top.

Figure 5A:
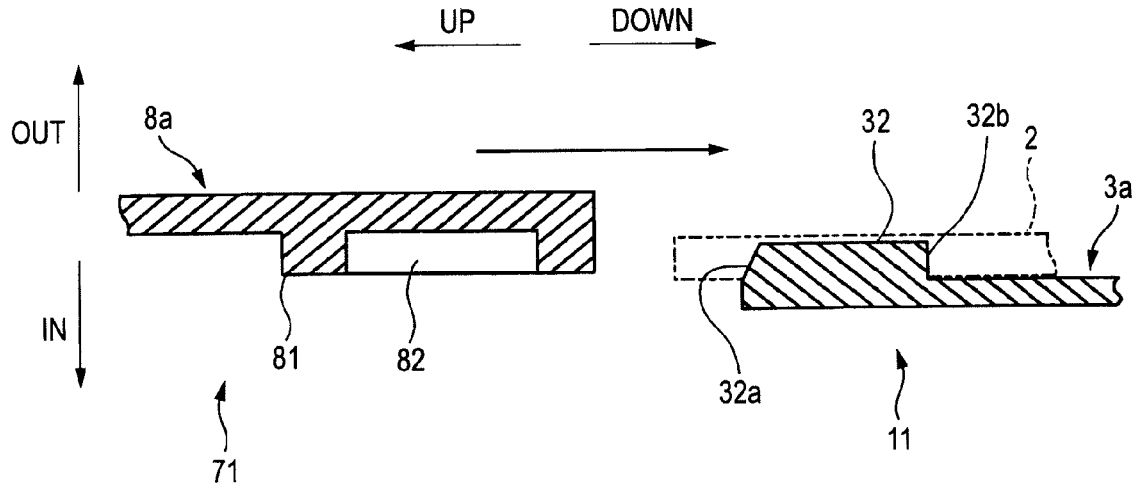
FIGS. 5A and 5B are partial sectional views illustrating structures of opening edge portions of an electric wire outlet port of the housing and an attaching port of the electric wire cover.
Figure 5B:
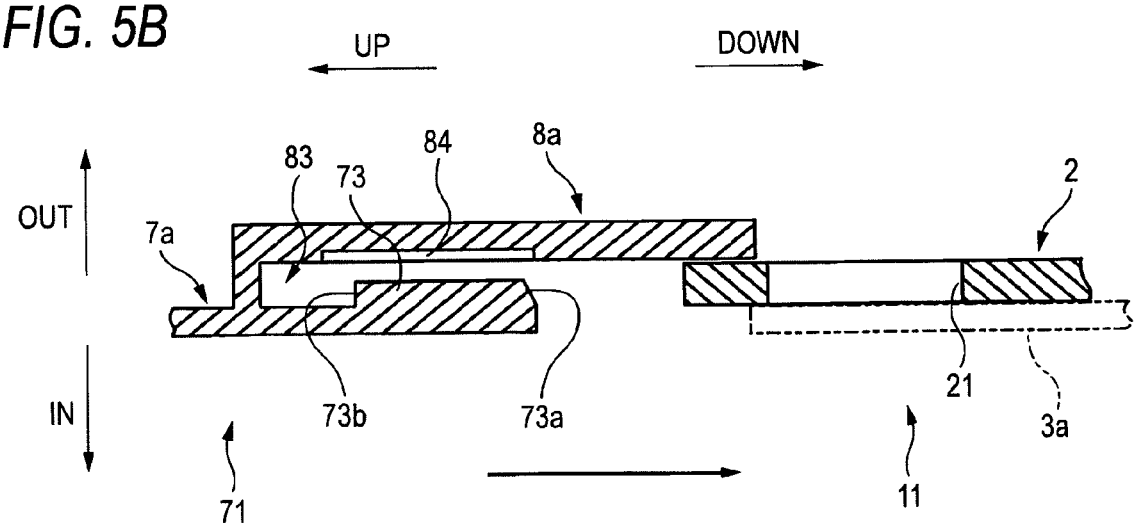

The main wall portions 3*a* extend outwardly to the left and right directions, respectively, from inner surfaces of the left- and right-hand side edge portions of the main circumferential walls 2, and outer surfaces of the main wall portions 3*a* are positioned further inwards by a distance equal to the thickness of the main circumferential wall 2 than outer surfaces of the main circumferential walls 2 (refer to FIGS. 5A and 5B). The main wall portions 3*a* are made to continue to the main circumferential walls 2 and make up main surfaces of the housing 1. In addition, the side wall portions 3*b* connect together the main wall portions 3*a* which face each other at the left- and right-hand sides of the main circumferential walls 2 so as to make up left- and right-hand side surfaces of the housing.

The housing 1 includes an electric wire outlet port 11 which communicates with the respective terminal cavities provided in the interior thereof and which is made to open at an upper end side thereof. The electric wire outlet port 11 has a substantially rectangular opening shape which is surrounded by the main circumferential walls 22 and the connecting circumferential wall portions 3. As is shown in FIG. 1, the electric wire outlet port 11 is made for the electric wires D connected to terminals which are accommodated in the respective terminal cavities of the housing 1 to be drawn out to the outside. The main circumferential walls 2 and the pair of main wall portions 3*a* which extend sideways from the left- and right-hand side edge portions of the main circumferential walls 22 make up, respectively, locked wall portions which constitute circumferential walls of the electric wire outlet port 11. A connector attaching port or inlet port (not shown) is opened in the housing 1 at a lower end side thereof for a mating connector to be fitted therein for attachment.

As is shown in FIG. 2, locking holes 21 each having a substantially rectangular opening shape are formed in both the main surfaces of the housing 1 in such a manner as to each pierce the main circumferential wall 2 from an outer surface side to an inner surface side. One locking hole 21 is provided to be disposed in each of upper left- and right-hand side corner portion of each of the main circumferential walls 2. The locking holes 21 provided on one of the main circumferential walls 2 are disposed in positions which confront the locking holes 21 which are provided on the other main circumferential wall 2 which faces the one main circumferential wall 2.

Projections 32 are provided on both the main surfaces of the housing 1 which are situated further sideways to the left and right than the locking holes 21. The projections 32 are formed at upper edge portions of the main wall portions 3*a* which are situated slightly further downwards than the locking holes 21 and project outwards from outer surfaces of the main wall portions 3*a*. The projection 32 provided on one of the main wall portions 3*a* is disposed in a position which confronts the projection 32 provided on the other main wall portion 3*a* which faces the one main wall portion 3*a*. The projection 32 exhibits a substantially angular block shape, and an upper surface 32*a* is inclined outwardly downwards while a lower surface 32*b* is erected vertically outwards. A guiding projecting portion 31 is formed on an outer surface of the side wall portion 3*b* in such a manner as to extend along a height direction.

As is shown in FIG. 1, a lever 4 is attached to the housing 1. The lever 4 is provided to lie on both the main surfaces of the housing 1 for detaching the mating connector from the connector inlet port (not shown) at the lower end side of the housing. The lever 4 is attached to the housing 1 in such a manner as to cover an upper portion of the side wall portion 3*b* of the connecting circumferential wall 3 provided at either the left- or right-hand side of the housing 1 and both the main surfaces of the housing 1 which extend from the main wall portions 3*a* to central portions of the main circumferential walls 2 and holds the guiding projecting portion 31 provided on the side wall portion 3*b* from both sides thereof.

Figure 3:
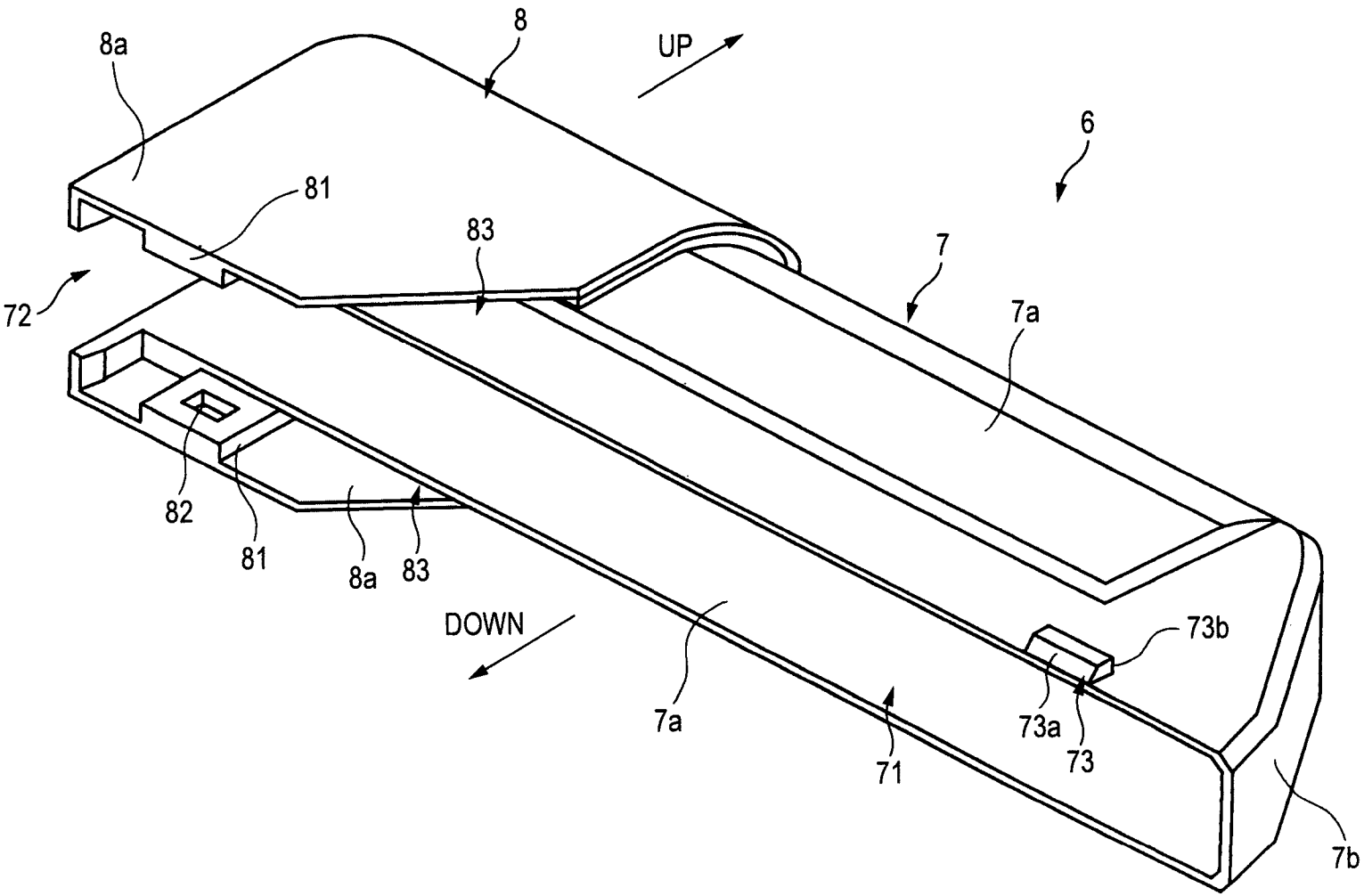
FIG. 3 is a perspective view, as seen from below, showing an external appearance of the electric wire cover shown in FIG. 1.
Figure 4:
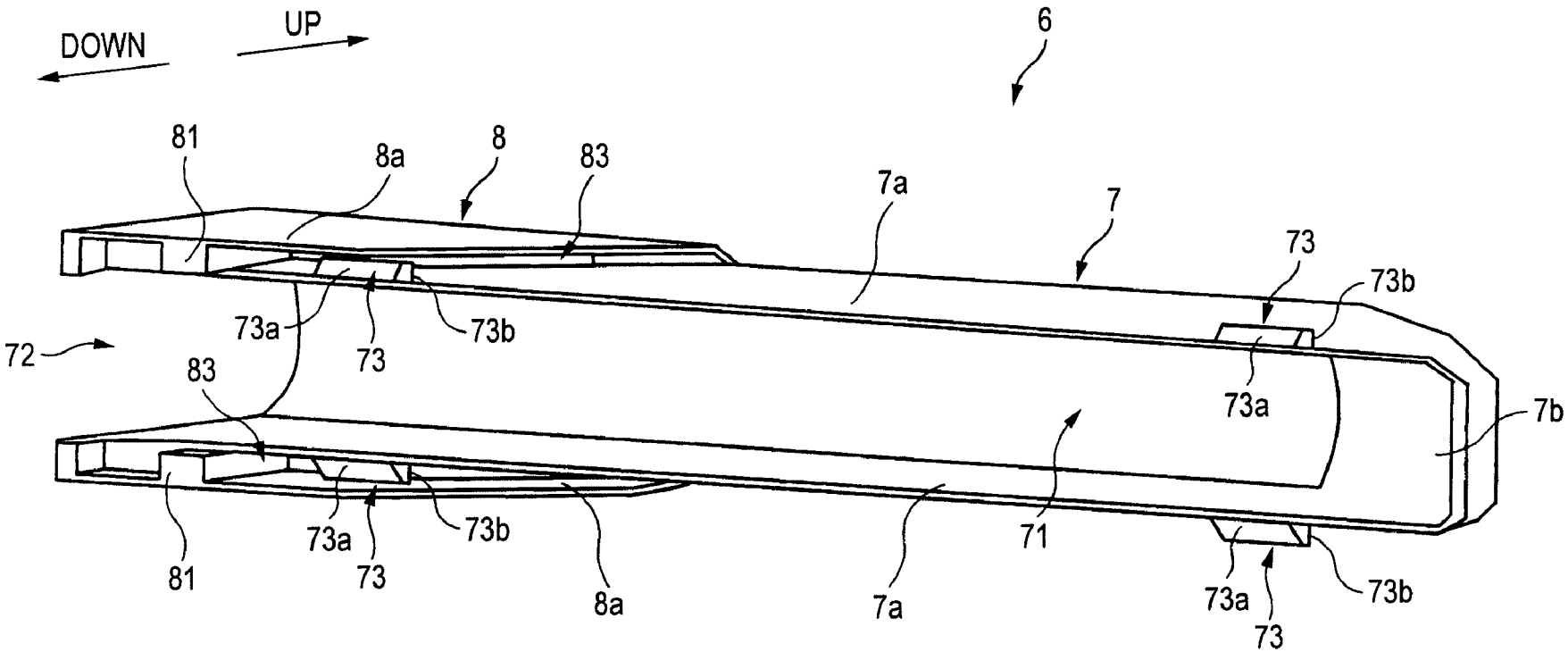
FIG. 4 is a perspective view, as seen from below, showing an inside of the electric wire cover shown in FIG. 3.

FIG. 3 is a perspective view, as seen from therebelow, which shows an external appearance of the electric wire cover 6. In addition, FIG. 4 is a perspective view, as seen from therebelow, which shows an inside of the electric wire cover 6. Additionally, FIGS. 5A and 5B show partial sectional views which illustrate structures of opening edge portions of the electric wire outlet port 11 of the housing 11 and an attaching port 71 of the electric wire cover 6.

As is shown in FIG. 3, the electric wire cover 6 is configured to include a cover main body 7 which is fitted in the housing 1 for attachment and a cover lock 8 which covers an outer surface of the cover main body 7. The cover main body 7 has a flat, substantially box-shaped external shape is formed by connecting a pair of main inner walls 7*a*, which face each other and make up a main surface of the cover main body 7, with a side inner wall 7*b*, which connects together side edge portions of both the main inner walls 7*a* so as to constitute a side surface of the cover main body 7, at upper edge portions of the respective inner walls 7*a*, 7*b* with a side portion provided with no side inner wall 7*b* opened over a full area thereof. In the cover main body 7, the attaching port 71 which is surrounded by lower edge portions of both the main inner walls 7*a* and the side inner wall 7*b* so as to have a substantially rectangular shape is made to open to a lower end side of the cover main body 7. The main inner wall 7*a* constitutes one locking wall portion which is brought into locking engagement with the main circumferential wall 2 of the housing 1 from the inner surface side. In addition, the opening which is formed over the full area of the side portion of the cover main body 7 constitutes an electric wire passing port 72 from which the electric wires D (refer to FIG. 1) are drawn out from the inside of the cover main body 7 to the outside.

As is shown in FIG. 4, locking projections 73 are provided at both side portions of each of the main surfaces of the cover main body 7. The locking projections 73 are positioned at a lower edge portion of the main inner wall 7*a* and project outwards from an outer surface of the main inner wall 7*a*. The locking projections 73 provided on one of the main inner walls 7*a* are disposed in positions which confront the locking projections 73 provided on the other main inner wall 7*a* which faces the one inner fall 7*a*. As is shown in FIG. 3, the locking projection 73 exhibits a substantially angular block shape, and a lower surface 73*a* is inclined outwardly upwards, and an upper surface 73*b* is erected vertically outwards.

As is shown in FIG. 3, the cover lock 8 is made integral with the cover main body 7 in such a manner as to cover an outer surface of a side portion of the cover main body 7 where the electric wire passing port 72 is formed and main outer walls 8*a* formed at lower edge portions thereof are made to extend further downwards than the lower edge portions of the main inner walls 7*a*. The main outer wall 8*a* constitutes one locking wall portion which is brought into locking engagement with the main circumferential wall 2 of the housing 1 from the outer surface side. A swollen portion 81 is provided at the lower edge portion of the main outer wall 8*a*, and the swollen portion 81 is made in such a manner that an inner surface of the main outer wall 8*a* is swollen inwards. The swollen portion 81 exhibits a substantially angular block shape and has, as is shown in FIG. 5A, substantially the same thickness as the main circumferential wall 2 of the housing 1.

As is shown in FIG. 3, a locking groove 82 is formed on an end face of the swollen portion 81 which is oriented inwards of the electric wire cover 6. The locking groove 82 provided on the swollen portion 81 of one of the main outer walls 8*a* is disposed in a position which confronts the locking groove 82 provided on the other main outer wall 8*a* which faces the one main outer wall 8*a*. As is shown in FIG. 4, a gap 83 is provided between a portion of the main outer wall portion 8*a* which lies closer to the side inner wall 7*b* than the swollen portion 81 and the lower edge portion of the main inner wall 7*a*. As is shown in FIG. 5B, the gap 83 has space which is slightly longer than the thickness of the main circumferential wall 2 provided on the housing 1. In addition, as is shown in FIG. 5B, an accommodation groove 84 is provided on an inner surface of a portion of the main outer wall 8*a* which lies closer to the side inner wall 7*b* than the swollen portion 81 in such a manner as to extend in a width direction of the main outer wall 8*a* along the position where the locking projection 73 is formed.

Next, an attaching and detaching operation of the electric cover 6 to and from the housing 1 will be described. FIGS. 6A to 8B are sectional views showing partially the opening edge portions of the electric wire outlet port 11 provided on the housing 1 and the attaching port 71 provided on the electric wire cover 6 and are diagrams illustrating an attaching operation of the electric cover 6 to the housing 1.

As is shown in FIG. 1, the electric wire cover 6 is attached to the housing 1 in such a state that the lever 4 is attached to the side wall portion 3*b* of one of the left- and right-hand side connecting circumferential walls 3 and the electric wires D connected to the terminals in the terminal cavities are drawn out from the electric wire outlet port 11. In the example shown in the same figure, the electric wire cover 6 is attached to the housing 1 in such a state that the lever 4 is attached to the side wall portion 3*b* of the right-hand side connecting circumferential wall 3 of the housing 1.

When attaching the electric wire cover 6 to the housing 1, as is shown in FIG. 1, the attaching port 71 of the cover main body 7 is oriented to the electric wire outlet port 11 of the housing 1 in such manner that the side portion of the electric cover 6 on which the cover lock 8 is provided is made to face the left-hand side connecting circumferential wall 3 to which the lever 4 is not attached and the electric cover 6 is forced into the housing 1 in such a manner that a circumferential edge portion of the attaching port 71 is inserted into the electric wire outlet port 11 of the housing. By this operation, as is shown in FIG. 5A, each of the swollen portions 81 provided on the main outer walls 8*a* of the cover lock 8 moves downwards of the housing 1 as is shown by an arrow therein towards the upper edge portion of the main wall portion 3*a* which constitutes the opening edge portion of the electric wire outlet port 11. In addition, as is shown in FIG. 5B, the inner surface of the portion of the main outer wall 8*a* which lies closer to the side inner wall 7*b* than the swollen portion 81 approaches or comes into abutment with the outer surface of the upper edge portion of the main circumferential wall 2 which makes up the opening edge portion of the electric wire outlet port 11 and moves downwards of the housing 1 as is indicated by an arrow in the figures.

Figure 6A:
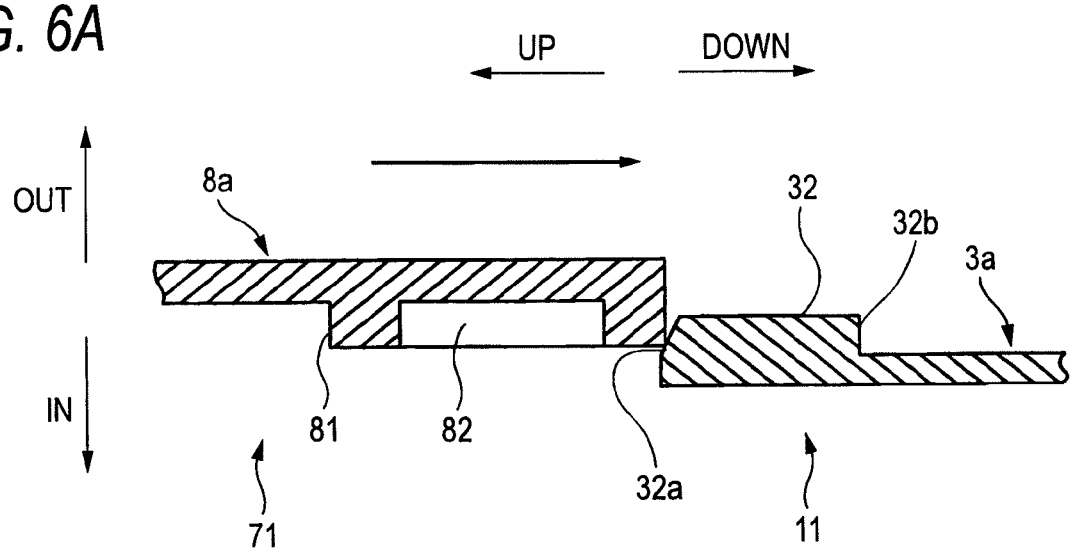
FIGS. 6A and 6B are diagrams describing operations at a first stage of the attachment of the electric wire cover to the housing.

As is shown in FIG. 6A, the swollen portion 81 of the main outer wall 8*a* which moves downwards of the housing 1 comes into abutment with the upper surface 32*a* of the projection 32 provided on the outer surface of the upper edge portion of the main wall portion 3*a*. The swollen portion 81 which has come into abutment with the upper surface 32*a* of the projection 32 then rides on the projection 32 from the upper surface 32*a* as is shown in FIG. 7A, and as this occurs, the swollen portion 81 is pressed from the projection 32 to thereby bend the main outer wall 8*a* outwards and at the same time presses the projection 32 to thereby bend the main wall portion 3*a* inwards.

Figure 6B:
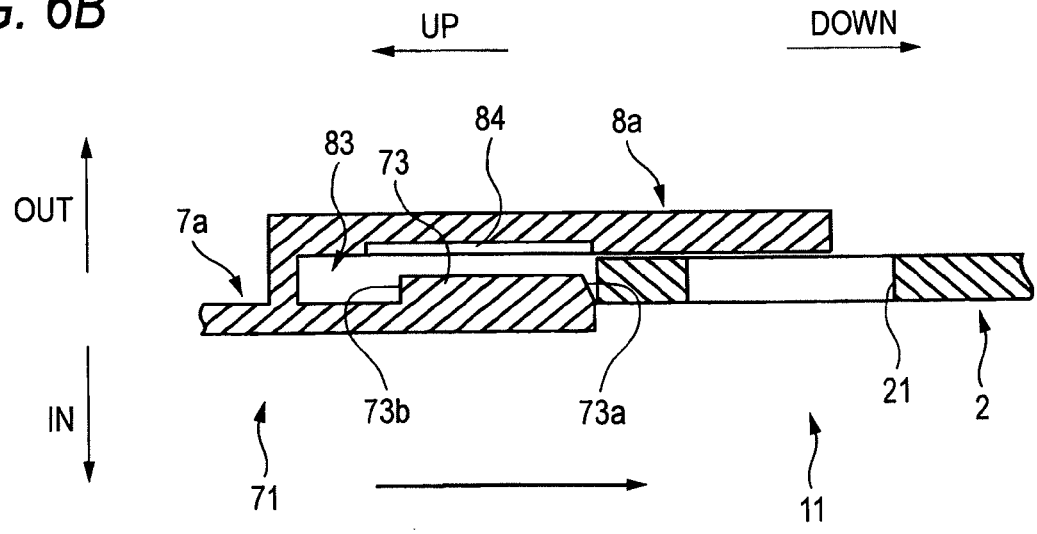

When the circumferential edge portion of the attaching port 71 is inserted into the electric wire outlet port 11 until the swollen portion 81 comes into abutment with the projection 32, the locking projection 73, which is provided on the outer surface of the main inner wall 7*a* in such a manner as to be positioned at the opening edge portion of the attaching port 71, is brought into abutment with the upper edge portion of the main circumferential wall 2 which makes up the opening edge portion of the electric wire outlet port 11 at the lower surface 73*a* thereof, as is shown in FIG. 6B. Then, the main circumferential wall 2 comes into abutment with the lower surface 73*a* of the locking projection 73 and rides on the locking projection 73 from the lower surface 73*a* as is shown in FIG. 7B. As this occurs, the main circumferential wall 2 is pressed by the locking projection 73 to thereby be bended outwards while pressing the locking projection 73 to bend the main inner wall 7*a* inwards. In addition, as is shown in FIG. 7B, an upper edge portion of the main circumferential wall 2 which is being bended outwards is accommodated in the accommodation groove 84 provided on the main outer wall

8*a*, whereby the main circumferential wall 2 presses a bottom surface of the accommodation groove 84 or an inner surface of the main outer wall 8*a* to thereby bend the main outer wall 8*a* outwards.

Figure 7A:
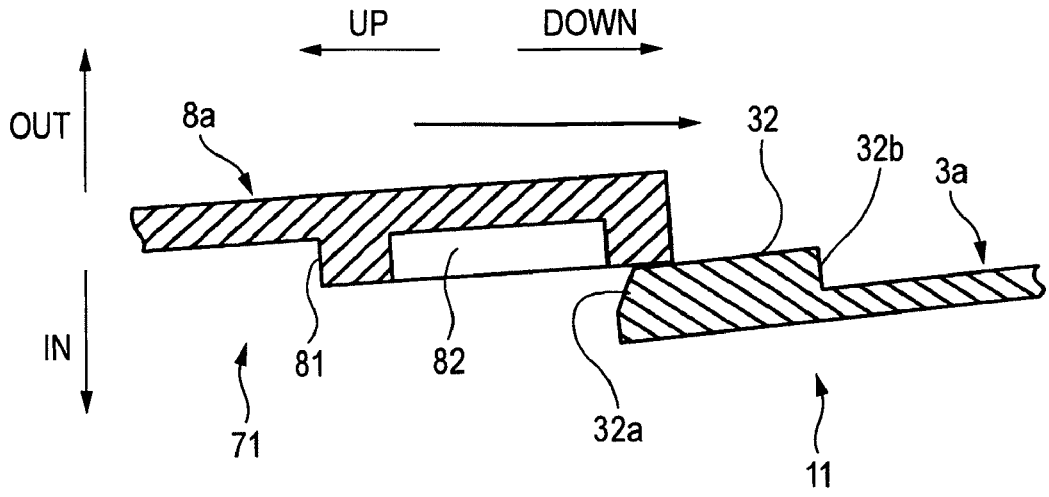
FIGS. 7A and 7B are diagrams describing operations at a second stage of the attachment of the electric wire cover to the housing.
Figure 7B:
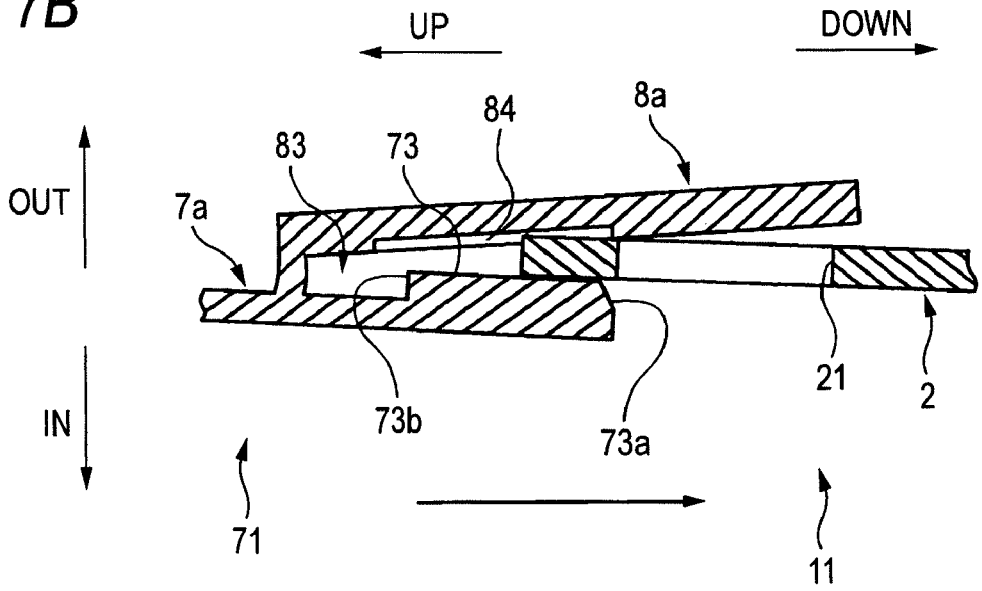
Figure 8A:
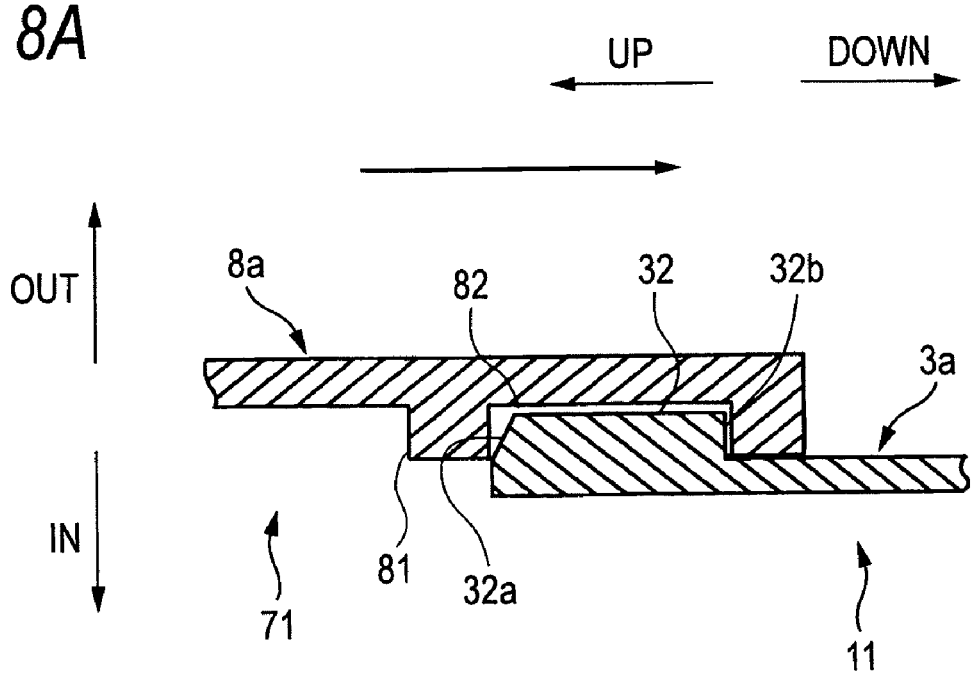
FIGS. 8A and 8B are diagrams describing operations at a third stage of the attachment of the electric wire cover to the housing.
Figure 8B:
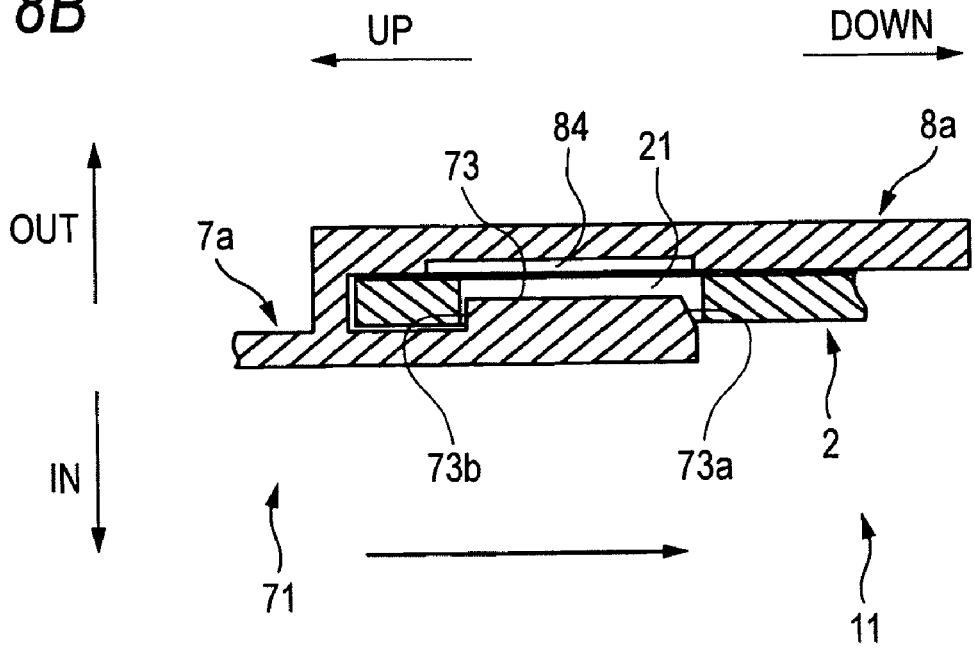

As is shown in FIG. 7A, when the swollen portion 81 rides on the projection of the main wall portion 3*a* and moves downwards of the housing 1 as indicated by an arrow in the same figure to arrive at a position where it faces the locking groove 82, the swollen portion 81 falls in the locking hole 21, as is shown in FIG. 8B. As this occurs, the pressure exerted on the main circumferential wall 2 on the locking projection 73 provided on the main inner wall 7*a* is released.

The bending of the main inner wall 7*a*, the main outer wall 8*a* and the main circumferential wall 2 is released by the pressing of the swollen portion 81 on the main outer wall 8*a* by the projection 32 on the main wall portion 3*a* and the pressing of the main circumferential wall 2 by the locking projection 73 on the main inner wall 7*a* being released, whereby the cover main body 7 is fitted in the electric wire outlet port 11 and the cover lock 8 is fitted thereon, as a result of which the electric wire cover 6 is attached to the housing 1, the attaching work of the electric wire cover 6 to the housing 1 being thereby completed.

In the attaching structure of the electric wire cover 6 that is configured in the way described heretofore, by the projection 32 being fitted in the locking groove 82 as is shown in FIG. 8A, the main outer wall 8*a* of the cover lock 8 comes into locking engagement with the main wall portion 3*a* of the housing 1 from an outer surface side. In addition, as is shown in FIG. 8B, by the locking projection 73 being fitted in the locking hole 21, the main inner wall 7*a* of the cover main body 7 comes, together with the main wall portion 3*a*, into locking engagement with the main circumferential wall 2 which makes up the locked wall portion from an inner surface side. Furthermore, as is shown in FIG. 8B, the main inner wall 7*a* which locks the main circumferential wall 2 from the inner surface side and the main outer wall 8*a* which locks from the outer surface side the main wall portion 3*a* which is consecutive to the main circumferential wall 2 are disposed in such a manner as to hold the main circumferential wall 2 therebetween from the inner surface side and from the outer surface side, respectively.

When detaching the electric wire cover 6 from the housing 1, firstly, both the main outer walls 8*a* provided on the cover lock 8 are bended outwards by pulling them upwardly outwards so that the inner surfaces of both the main outer wall 8*a* move apart from the outer surfaces of the main wall portions 3*a* provided on the housing 1. By this action, the locking grooves 82 in which the projections 32 are fitted as is shown in FIG. 8A move upwards to be apart from the projections 32, whereby the fitting of the projections 32 in the locking grooves 82 is released.

Next, both the main inner walls 7*a* provided on the cover main body 7 are bended inwards by pressing them inwards so that the outer surfaces of both the main inner walls 7*a* move apart from the inner surfaces of the main circumferential walls 2 in such a state that the fitting of the projections 32 in the locking grooves 82 is released by bending the main outer walls 8*a* outwards. By this action, as is shown in FIG. 8B, the locking projections 73 fitted in the locking holes 21 move downwards of the locking holes 21, whereby the fitting of the locking projections 73 in the locking holes 21 is released.

After the locking between the locking grooves 82 on the cover lock 8 and the projections 32 on the housing 1 and the locking between the locking projections 73 on the cover main body 7 and the locking holes 21 on the housing 1 have been released in the ways described above, the electric wire cover 6 is pulled out from the electric wire outlet port 11 of the housing 1 in an opposite direction to the direction in which the electric wire cover 6 was attached. By this action, the electric wire cover 6 is detached from the housing 1.

According to the connector of the embodiment, since the main inner walls 7*a* of the cover main body 7 lock the main circumferential walls 2 of the housing 1 from the inner surface side and the main outer walls 8*a* of the cover lock 8 locks the main wall portions 3*a* which make up the locked wall portion together with the main circumferential walls 2 from the outer surface side, the locking by the main inner walls 7*a* and the main outer walls 8*a* is not released unless forces which move, respectively, the main inner walls 7*a* inwards of the housing 1 and the main outer walls 8*a* outwards of the housing 1 act on the electric wire cover 6 at the same time. Because of this, even though a load is exerted on the main surfaces of the housing 1 and the cover main body 7 in one vertical direction, unless a load is exerted thereon in an opposite direction to the one vertical direction at the same time, there occurs no situation where the locking by the main inner walls 7*a* and the main outer walls 8*a* is released so as to allow the cover main body 7 to be detached from the housing 1, and thus, the cover main body 7 can be made difficult to be detached from the housing 1. As a result of this, the detachment of the electric wire cover 6 from the housing 1 can be prevented.

In addition, according to the connector of this embodiment, since the main outer walls 8*a* which are made integral with the main inner walls 7*a* are disposed closely above the locking holes 21 situated at one of the left and right sides of the main circumferential walls 2 so that the locking holes 21 are restricted from moving outwards of the main inner walls 7*a* to thereby release the locking thereof with the locking projections 73 by the main outer walls 8*a*, the release of the locking between the locking holes 21 and the locking projections 73 can be prevented effectively. As a result of this, the detachment of the electric wire cover 6 from the housing 11 can be prevented effectively.

Additionally, according to the connector of this embodiment, even though the locking projections 73 move out of the locking holes 21 and the projections 32 move out of the locking grooves 82, since the main inner walls 7*a* which are pressed by the main circumferential walls 2 via the locking projections 73 to thereby be bended inwards and the main outer walls 8*a* which are pressed by the projections 32 at the swollen portions 81 thereon to thereby be bended outwards exert spring-back forces generated by the bending on the locked wall portion which is made up of the main circumferential walls 2 and the main wall portions 3*a* in such a manner as to hold it therebetween, the release of the locking between the locking holes 21 and the locking projections 73 can be prevented effectively by virtue of the bending of the main circumferential walls 2 and the main inner walls 7*a*. As a result of this, the detachment of the electric wire cover 6 from the housing 1 can be prevented effectively.

In the description of the embodiment that has been made heretofore, while the case has been described in which the main outer walls 8*a* of the cover lock 8 extend further downwards than the main inner walls 7*a* of the cover main body and the locking grooves 82 are made to be exposed to the inside of the attaching port 71, a configuration may be adopted in which the main outer walls 8*a* are positioned such that lower edge portions thereof confront lower edge portions of the main inner walls 7*a* or lie thereabove and the locking grooves 82 are made to confront the main inner walls 7*a*. In addition, the numbers of locking holes 21 provided on the main circumferential walls 2 and locking projections 73 provided on the main inner walls 7*a* are arbitrary, provided that they are provided in pairs. In addition, the numbers of projections 32 provided on the main wall portions 3*a* and locking grooves 82 provided on the main outer walls 8*a* are arbitrary, provided that they are provided in pairs. For example, a configuration may be adopted in which a pair of locking hole 21 and projection 32 is provided at a left-hand side portion of one of the main surface of the housing 1 and another pair of locking hole 21 and projection 32 is provided at a right-hand side portion of the other main surface, and pairs of locking projection 73 and locking grooves 82 are provided on the cover main body 7 and the cover lock 8 in positions corresponding to the pairs of locking hole 21 and projection 32.

In addition, the shapes of the locking hole 21 and the locking projections 73 are arbitrary, provided that the locking projections 73 are fitted individually in the locking holes 21 so that the main inner walls 7 lock the main circumferential walls 2 from the inner surface side. For example, the locking projection 73 may have a shape in which the lower surface 73 rises vertically outwards. In addition, the locking holes 21 and the locking projections 73 do not necessarily have to be provided at the opening edge portions of the electric wire outlet port 11 and the attaching port 71. Additionally, the shapes of the projection 32 and the locking groove 82 are arbitrary, provided that the main outer walls 8*a* are allowed to lock the main wall portions 3*a* from the outer surface side by fitting the projections 3*a* in the locking grooves 82. For example, the projection 32 may have a shape in which the upper surface 32*a* rises vertically outwards. In addition, the projections 32 and the locking grooves 82 do not necessarily have to be provided at the opening edge portion of the electric wire outlet port 11 and the lower edge portions of the cover lock 8.

Additionally, the locking portions where the main inner walls 7*a* are brought into locking engagement with the main circumferential walls 2 via the locking projections 73 are not limited to the locking holes 21 which pierce the main circumferential walls 2 but may take the form of a hole or groove which is formed on the inner surface of the main circumferential wall 2. In addition, the locking portions where the main outer walls 8*a* are brought into locking engagement with the main circumferential walls 2 via the projections 32 are not limited to the locking grooves 82 but may take the form of a hole which pierces the main outer wall 8*a* or a hole formed on the inner surface of the main outer wall 8*a*. Additionally, provided that the main inner walls 7*a* and the main outer walls 8*a* can be brought into locking engagement with the main circumferential walls 2 from the outer surface side or the inner surface side, a configuration may be adopted in which projections provided on either of the main inner walls 7*a*/the main outer walls 8*a* and the main circumferential walls 2 are locked in locking portions such as holes provided on the other of the main inner walls 7*a*/the main outer walls 8*a* and the main circumferential walls 2. In addition, in the description of the embodiment, the case has been described in which the main circumferential walls 2 and the main wall portions 3*a* which are provided on the housing 1 constitute the single locked wall portion. However, the configuration of the locked wall portion is arbitrary, and for example, the locked wall portion may be made up of a single flat wall member. As this occurs, a configuration can be adopted in which no swollen portion 81 is provided on the main outer walls 8*a* and the locking grooves 82 are provided directly on the inner surfaces of the main outer walls 8*a*.

In addition, in the description of the embodiment, while the case has been described in which the electric wire cover 6 includes the tow locking wall portions such as the main inner walls 7*a* and the main outer walls 8*a*, a configuration may be adopted in which three or more locking wall portions are provided. As this occurs, a configuration may be adopted in which respective locking wall portions are superposed one on another at predetermined intervals with main surfaces thereof oriented in the same direction or in which part of the locking wall portions are disposed parallel. Additionally, also in a case where the housing 1 includes a plurality of locking wall portions, a configuration may be adopted in which respective locking wall portions are superposed one on another at predetermined intervals with main surfaces thereof oriented in the same direction or in which part of the locking wall portions are disposed in a rowl. In a case where one of the housing 1 and the electric wire cover 6 includes three or more locking wall portions, the number of locking wall portions which are brought into locking engagement with the outer surface side and the inner surface side of the one locked wall portion provided on the other can be determined arbitrary.

In addition, in the description of the embodiment, while the case has been described in which the invention is applied to the attaching structure of the electric wire cover 6 provided on the connector, the invention can also be applied to attaching structures of other covers.

What is claimed is:

1. A cover attaching structure in a connector, comprising:

first and second locking portions respectively provided on outer and inner walls of a first attaching member; and third and fourth locking portions respectively provided on inner and outer walls of a second attaching member which is attached to the first attaching member, wherein the first locking portion is locked on the third locking portion from an outer surface side of the connector; and wherein the second locking portion is locked on the fourth locking portion from an inner surface side of the connector; and wherein the outer wall of the first attaching member covers both of the third and fourth locking portions.

2. The cover attaching structure according to claim 1, wherein at least one of the first and third locking portion has a projection; and wherein at least one of the second and fourth locking portion has a projection.

3. A housing which includes one of the first and second attaching member as described in claim 1.

4. A cover which includes one of the first and second attaching member as described in claim 1.

5. The cover attaching structure according to claim 1, wherein an accommodation groove is provided on an inner surface of the outer wall of the first attaching member, and when the first and second attaching members are to be locked together, the outer wall of the second attaching member passes into the accommodation groove, thereby in a locking state.

6. The cover attaching structure according to claim 1, wherein the first and second locking portions are provided on at least one locking wall of the first attaching member; and wherein the third and fourth locking portions are provided on a plurality of locking walls of the second attaching member.

7. The cover attaching structure according to claim 6, wherein the locking wall of the first attaching member is disposed between the plurality of the locking walls of the second attaching member in a state where inner and outer surfaces of the locking wall of the first attaching member abut on or are close to the plurality of the locking walls of the second attaching member.

8. The cover attaching structure according to claim 6, wherein the first attaching member is a housing, and the second attaching member is a cover;

wherein the housing includes a wire port into which the wire is inserted;

wherein the cover includes an inner wall which is fitted to inside of the wire port, and an outer wall which is fitted to outside of the wire port;

wherein a circumferential wall of the wire port serves as the at least one locking wall of the first attaching member; and wherein the inner and outer walls of the cover serve as the plurality of locking walls of the second attaching member.

9. A cover attaching structure in a connector, comprising:

a housing and an electric wire cover;

wherein the housing comprises locking holes and first projections for attaching to the electric wire cover in a locking state, and a circumferential wall for surrounding a plurality of wires, wherein the electric wire cover comprises second projections and locking grooves for mating with the locking holes and first projections, respectively, on the housing when in the locking state, wherein the electric wire cover has inner and outer walls, the inner wall being on one side and the outer wall being on the other side of the circumferential wall of the housing when the housing and the electric wire cover are in the locking state, and wherein the outer wall of the electric wire cover covers at least one of the locking holes and at least one of the first projections.

* * * * *